US005105065A

United States Patent [19]

Shibata

[11] Patent Number: 5,105,065

[45] Date of Patent: Apr. 14, 1992

[54] ELECTRICALLY HEATED BRANDING DEVICE

[75] Inventor: Masato Shibata, Tokushima, Japan

[73] Assignee: Shikoku Kakoki Co., Ltd., Tokushima, Japan

[21] Appl. No.: 498,569

[22] Filed: Mar. 23, 1990

Related U.S. Application Data

[62] Division of Ser. No. 184,562, Apr. 21, 1988, Pat. No. 4,956,573.

[30] Foreign Application Priority Data

Apr. 24, 1987 [JP] Japan ..... 62-102295

[51] Int. Cl.[5] ..... H05B 1/00; H05B 3/00; B44B 5/00

[52] U.S. Cl. ..... 219/227; 101/9; 101/31; 219/216; 219/228; 219/236; 219/543

[58] Field of Search ..... 219/221, 227, 228, 229, 219/233, 235, 240, 243, 216, 236, 543, 533; 101/9, 25, 27, 31

[56] References Cited

U.S. PATENT DOCUMENTS

| | | | |
|---|---|---|---|
| 1,157,687 | 10/1915 | Garner et al. | 219/227 |
| 1,708,995 | 4/1929 | Abbott | 219/239 |
| 1,855,475 | 4/1932 | Covey | 219/229 |
| 1,960,776 | 5/1934 | Flothow | 101/31 |
| 2,031,532 | 2/1936 | Goldman | 219/229 |
| 2,231,766 | 2/1941 | Leibowitz | 101/31 |
| 2,288,464 | 6/1942 | Kitchener | 219/227 |
| 2,488,477 | 11/1949 | Rapaport | 219/237 X |
| 3,584,190 | 6/1971 | Marcoux | 219/229 |

FOREIGN PATENT DOCUMENTS

| | | | |
|---|---|---|---|
| 697412 | 10/1930 | France | 219/227 |
| 701935 | 1/1931 | France | 219/228 |

*Primary Examiner*—Anthony Bartis
*Attorney, Agent, or Firm*—Armstrong, Nikaido, Marmelstein, Kubovcik & Murray

[57] ABSTRACT

An electrically heated branding device for marking articles has an elongated type block with a base end removably secured in a cavity of a holder and a branding indicia on a forward end face which projects from the holder. The type block includes a metallic heat receiving portion having an elongated cavity open at the base end of the type block and in which as fitted a heat generating portion in the form of a ceramic rod. An electric resistance heat generating member having a positive temperature coefficient of resistance is embedded in the forward end portion of the rod and extends transversely of the longitudinal axis thereof for heating the indicia. Lead wires from heat generating member are connected to electrodes removably received in a socket in the cavity.

3 Claims, 3 Drawing Sheets

FIG.1
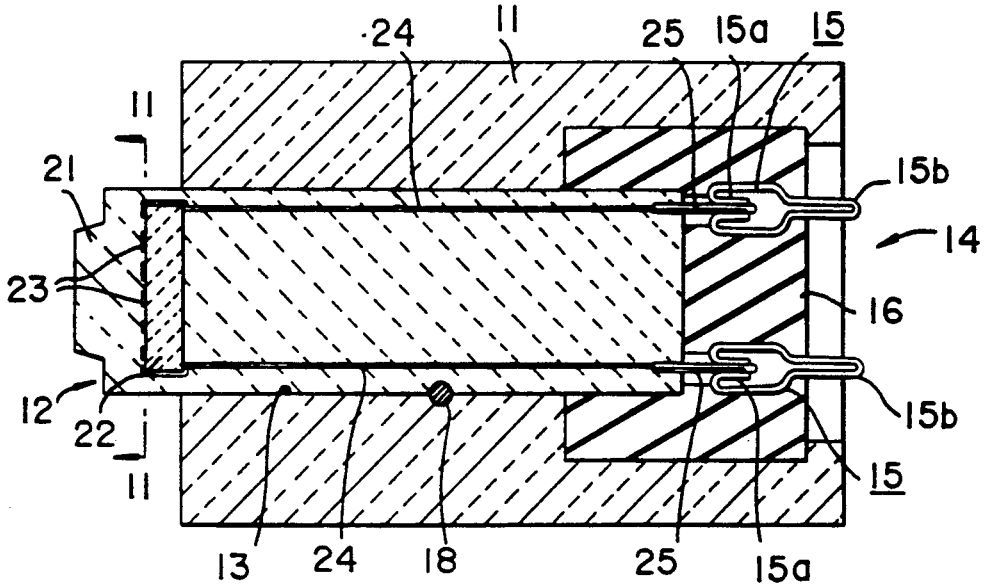
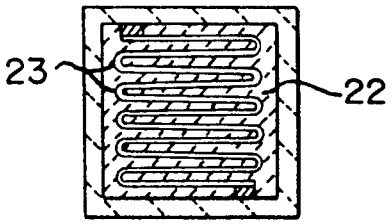
FIG.2
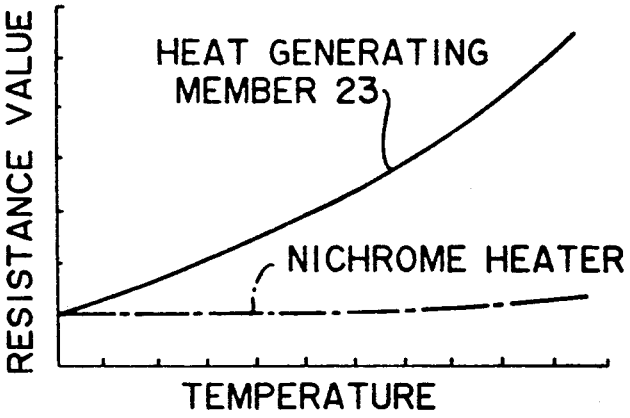
FIG.3

FIG.4
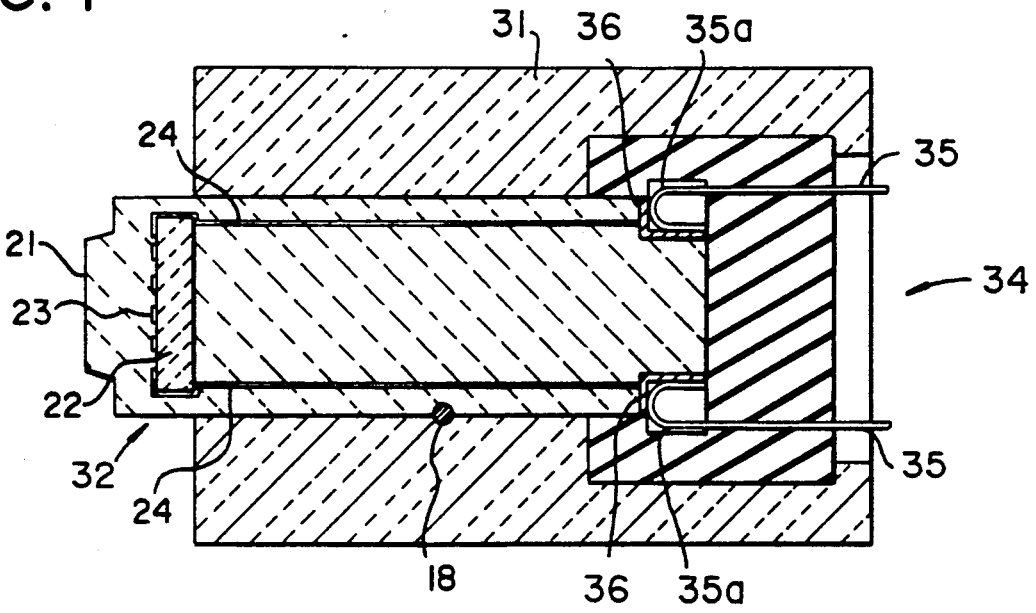
FIG.5
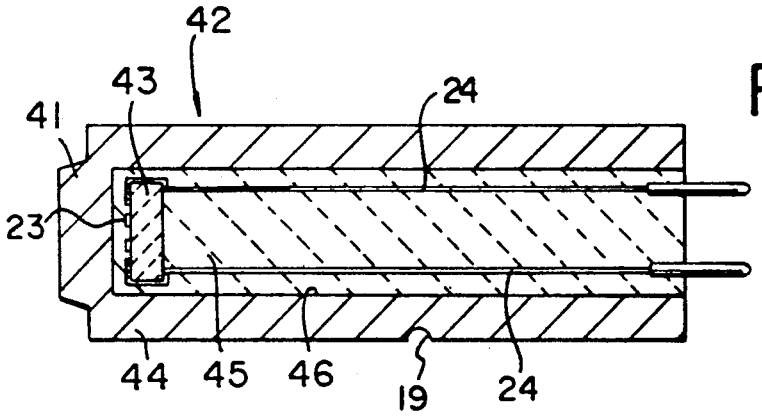
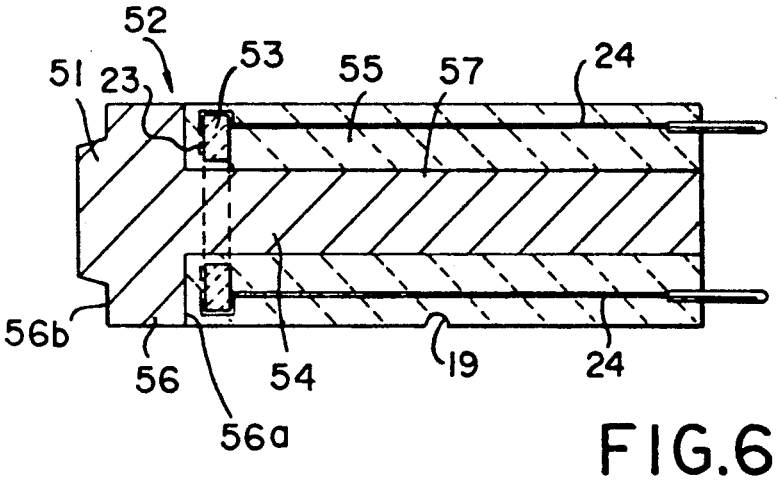
FIG.6

ELECTRICALLY HEATED BRANDING DEVICE

This application is a divisional application of pending application Ser. No. 184,562, filed on Apr. 21, 1988, now U.S. Pat. No. 4,956,543 granted Sept. 11, 1990.

BACKGROUND OF THE INVENTION

The present invention relates to a branding device which is useful, for example, for marking the date of manufacture on containers containing food or beverage.

FIG. 8 shows such a device heretofore known which comprises a holder 80 and type blocks 81 removably attached to the holder 80. The holder 80 is in the form of a horizontally elongated rectangular parallelepipedal block made of a metal, such as copper alloy, having good heat conductivity. The holder 80 has two rectangular parallelepipedal type block holding cavities 82 which are horizontally elongated, opened toward the front and arranged longitudinally of the holder, and a heater insertion bore 83 extending through the holder 80 longitudinally thereof. An L-shaped NICHROME wire heater 85 is inserted at its horizontal portion in the bore 83. A plurality of type blocks 81, each in the form of a rectangular to square bar, are arranged side by side horizontally as inserted in each cavity 82, with the forward ends of the type blocks 81 projecting forward beyond the holder 80. A type locking rod 86 bent like a crank is removably attached to the holder 80, whereby the type blocks 81 are removably retained in the holder 80 although a detailed description will not be given.

With the device described above, the holder 80 is heated by the heater 85, and the type blocks 81 are heated with the heat transmitted thereto from the holder 80. Thus, the holder 80 which has an exceedingly greater heat capacity than the type blocks 81 is maintained at a high temperature so as to diminish the variation in the temperature of the type block 81 during branding operation. However, the device has the following problems. First, the holder 80 releases a large amount of heat, hence a great heat loss. Second, heat is transferred from the heater 85 to the type blocks 81 through the holder 80, so that the heater 85 needs to produce such an amount of heat as to give a temperature which is higher than the temperature of the type blocks 81 required for branding by an amount corresponding to the heat transfer loss. This is likely to shorten the life of the heater 85. Third, the holder 80 having a high temperature and left exposed is likely to contact the worker to cause a burn, hence a safety problem.

SUMMARY OF THE INVENTION

The main object of the present invention is to provide a branding device free of the foregoing problems.

The present invention provides a branding device which comprises a holder, and a type block removably attached to the holder with its one end projected from the holder. The type block has a character, symbol, figure or like pattern on the face of the projected end and a heat generating member.

The heat generating member is preferably embedded in a projected forward end of the type block.

In a preferred embodiment, the type block includes a heat receiving portion and a heat generating portion. The heat receiving portion is removably attached to the holder with one end projected from the holder and having a pattern on the projected end face. The heat receiving portion is formed with a cavity in alignment with its axis and open at its base end opposite the pattern. The heat generating portion is provided in the form of a bar fitted in the cavity and joined to the heat receiving portion. A heat generating member is embedded in the forward end portion of the heat generating portion.

In another embodiment, the type block includes a heat receiving portion and a heat generating portion, with the heat receiving portion in the form of a plate having two parallel faces and a rod extending from the plate perpendicular to one of the two faces. A pattern is provided on the other face. The heat generating portion is in the form of a tube fitted around the rod and joined thereto and a heat generating member is provided in the form of a ring embedded in and concentric with the forward end portion of the heat generating portion.

In the foregoing embodiments, it is preferred that the type block be made of a ceramic material, the heat generating member be an electric resistance member having a positive temperature coefficient and the type block be inserted in a socket at the bottom of a cavity in the holder. In these embodiments the type block is preferably provided with positive and negative electrodes for connection to the socket and the current input and output ends of the resistance member are connected to the respective electrodes by lead wires embedded in the type block.

In a still further embodiment, the forward end portion of the type block including the pattern is made of a heat generating electrically conductive material and the other portion of the type block is made of a ceramic material.

According to the various embodiments of the invention, the type block has a heat generating member for heating the type block directly, whereby all the foregoing problems heretofore encountered can be overcome. Thus, the present branding device is diminished in heat loss, has no problem as to the life of the heater and is usable with safety.

BRIEF DESCRIPTION OF THE DRAWINGS

FIG. 1 is a cross sectional view showing an embodiment of the invention;

FIG. 2 is a view in section taken along the line II—II in FIG. 1;

FIG. 3 is a graph showing the temperature coefficient of resistance of a heat generating member included in the embodiment;

FIG. 4 is a sectional view similar to FIG. 1 but showing another embodiment of the invention;

FIG. 5 is a sectional view of a type block which may be used in another embodiment of the invention;

FIG. 6 is a sectional view of a type block which may be used in a further embodiment of the invention;

DESCRIPTION OF THE PREFERRED EMBODIMENTS

Figure 7:
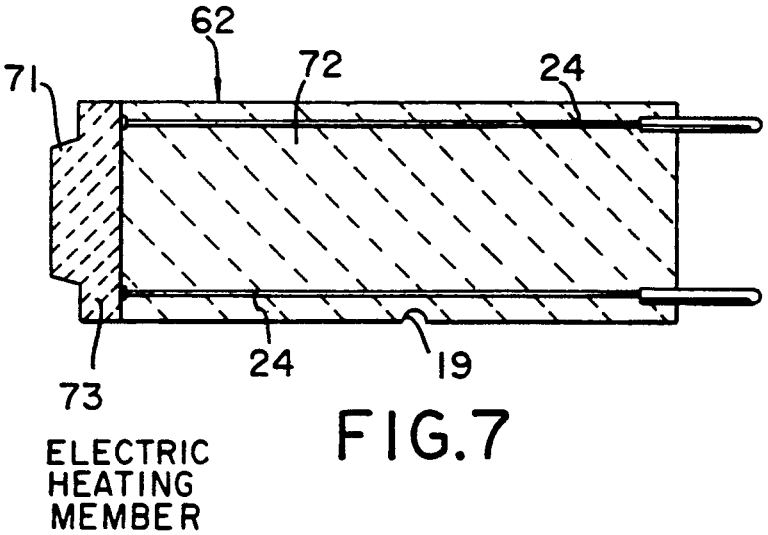
FIG. 7 is a sectional view of a type block which may be used in a still further embodiment of the invention.
Figure 8:
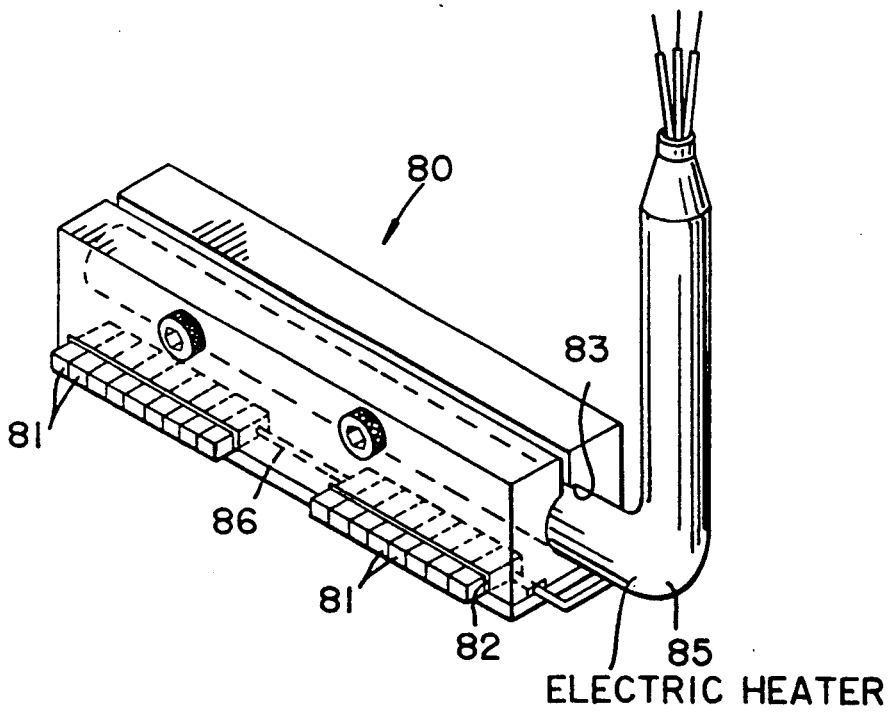
FIG.8 PRIOR ART
FIG. 8 is a perspective view showing a conventional device.

Embodiments of the invention will be described with reference to FIGS. 1 to 7.

FIG. 1 shows a branding device which comprises a holder 11 and type blocks 12 removably attached to the holder 11 by a locking rod 18 received in a notch 19.

The holder 11 is in the form of a horizontally elongated rectangular parallelepipedal block like the conventional one already described but is smaller than the conventional one. The holder 11 has a type block holding cavity 13 and a socket 14 embedded in the holder 11 at the bottom of the cavity 13. The socket 14 comprises a pair of spring plates 15 and an insulator 16. Each of the spring plates 15 has a contact portion 15*a* generally U-shaped in section, and a plug portion 15*b* of double structure. The contact portion 15*a* and the base end of the plug portion 15*b* are enclosed with the insulator 16. The plug portion 15*b* is projected from the insulator 16.

The type block 12 is in the form of a square to rectangular bar of ceramic and is inserted in the cavity 13 with its forward end projected from the holder 11. The type block 12 has a branding indicia in the form of a character, symbol, figure of like pattern 21 on the projected end face.

A heat generating member 23 is embedded in the forward end of the type block 12. The heat generating member 23 comprises a line of electric resistance material printed in a wavelength pattern on a ceramic plate 22 as seen in FIG. 2. The type block 12 has a pair of positive and negative electrodes 25 at its base end. The electrodes 25 are each in the form of a flat plate and inserted in the respective contact portions 15*a*. These electrodes 25 are connected to the respective power input terminal ends of the heat generating member 23 by a pair of lead wires 24 embedded in the type block 12.

FIG. 3 is a graph showing the temperature coefficient of resistance of the heat generating member 23 as one of its electric characteristics. With reference to the graph, the temperature coefficient of resistance of the heat generating member is represented by a solid line in comparison with that of a known NICHROME heater represented by a broken line. The heat generating member 23 has a positive temperature coefficient like known PTC thermistors. As will be apparent from the graph, the heat generating member 23 has an exceedingly higher temperature coefficient than the NICHROME heater. The resistance value increases with increasing temperature to decrease the current and remains unchanged at a specified temperature. When the device is used in this state for branding, the temperature of the heat generating member 23 drops to result in a lower resistance value, whereupon the current increases to produce an increased quantity of heat, consequently preventing the temperature from decreasing.

FIG. 4 shows another embodiment. A holder 31 has a socket 34 comprising spring plates 35, each of which has a contact portion 35*a* of U-shaped section. A type block 32 has electrodes 36 which are L-shaped to position the contact portions 35*a* in the respective spaces thereby defined.

FIG. 5 shows another embodiment.

The type block 42 of this embodiment comprises two portions, i.e. a heat receiving portion 44 and a heat generating portion 45. The heat receiving portion 44 is in the form of a square to rectangular bar and is attached to an unillustrated holder with its forward end projected from the holder. The heat receiving portion 44 has a pattern 41 on the projected end face and is formed with a cavity 46 in alignment with its axis and opened at its base end. The heat generating portion 45 is in the form of a round rod fitted in the cavity 46 and has a heat generating member 43 embedded in its forward end portion. The heat receiving portion 44 and the heat generating portion 45 are united by being bonded to each other.

FIG. 6 shows another embodiment.

The type block 52 of this embodiment, like the one shown in FIG. 5, comprises a heat receiving portion 54 and a heat generating portion 55. The heat receiving portion 54 comprises a square to rectangular plate 56 having two parallel faces 56*a*, 56*b*, and a round rod 57 integral with the plate 56 at the face 56*a* and perpendicular to the face 56*a*. The plate 56 has a pattern 51 on the other face 56*b* thereof. The heat generating portion 55 is in the form of a square to rectangular tube fitted around the rod 57 and has a ringlike heat generating member 53 embedded in its forward end portion.

The heat receiving portions 44 and 54 are made from metal. This increases workability and mechanical strength over comparable marking faces made of ceramics and prevents breakage of the marking face due to changes in temperature.

FIG. 7 shows still another embodiment.

The type block 62 of this embodiment, unlike those of the foregoing embodiments, has a forward end portion including a pattern 71 and serving as a heat generating member 73. The member 73 is made of a heat generating electrically conductive material containing silicon carbide, and the other portion serving as a heat insulating portion 72 is made of an insulation containing alumina. The two portions are sintered and thereby united.

While the invention has been particularly shown and described in reference to preferred embodiments thereof, it will be understood by those skilled in the art that changes in form and details may be made therein without departing from the spirit and scope of the invention.

What is claimed is:

1. A branding device comprising:

a holder, an elongated type block including an elongated heat receiving portion and an elongated heat generating portion, the heat receiving portion being removably attached to the holder with a forward end projected from the holder and having a branding indicia pattern on the projected forward end face thereof, the heat receiving portion being formed with an elongated cavity in alignment with its longitudinal axis and extending from said forward end to an opening at the opposite base end of said heat receiving portion, the heat generating portion being in the form of an elongated rod fitted in the cavity and joined to the heat receiving portion, and a heat generating member embedded in the forward end portion of said rod and extending transversely of the longitudinal axis thereof.

2. A device as defined in claim 1, wherein the rod is made of ceramic material, and the heat generating member comprises an electric resistance member having a positive temperature coefficient.

3. A device as defined in claim 2 wherein the holder is formed with a holding cavity having the heat receiving portion base end removably inserted therein and has a socket at the bottom of the holding cavity, and said rod is provided at its base portion with positive and negative electrodes detachably connected to the socket, and power supply terminal ends of the resistance member being connected to the respective electrodes by lead wires embedded in the rod.

* * * * *